US007152752B2

(12) United States Patent
Kurtenbach

(10) Patent No.: US 7,152,752 B2
(45) Date of Patent: Dec. 26, 2006

(54) MODULAR AND TRANSPORTABLE BOOKSHELVES

(76) Inventor: Joseph Kurtenbach, 6320 Poplar St., Commerce City, CO (US) 80022

( * ) Notice: Subject to any disclaimer, the term of this patent is extended or adjusted under 35 U.S.C. 154(b) by 86 days.

(21) Appl. No.: 10/963,234

(22) Filed: Oct. 12, 2004

(65) Prior Publication Data

US 2006/0076261 A1 Apr. 13, 2006

(51) Int. Cl.
*B65D 21/02* (2006.01)
*B65D 21/00* (2006.01)

(52) U.S. Cl. ..... 220/23.4; 220/23.6; 206/511

(58) Field of Classification Search ..... 220/772, 220/770, 234, 23.6; 294/161; 312/107, 312/273; 206/511, 509, 503
See application file for complete search history.

(56) References Cited

U.S. PATENT DOCUMENTS 2,483,269 A * 9/1949 Fender ..... 220/4.01
3,219,400 A * 11/1965 Bergquist ..... 312/107
3,361,293 A 1/1968 Box
3,512,696 A 5/1970 Ebert
3,565,624 A * 2/1971 Uffindell ..... 430/536
3,763,980 A * 10/1973 Vom Stein et al. ..... 193/35 R
4,190,172 A * 2/1980 Box ..... 220/510
4,322,118 A 3/1982 Shugart
4,389,078 A 6/1983 Streit
4,624,383 A * 11/1986 Moore ..... 220/23.4
4,660,725 A 4/1987 Fishman et al.
5,016,946 A * 5/1991 Reznikov et al. ..... 312/108
5,038,937 A 8/1991 DiSesa, Jr.
5,105,962 A * 4/1992 Gotz ..... 220/23.4
D330,128 S * 10/1992 Dziewa ..... D6/432
D332,745 S 1/1993 Koloski
5,310,071 A * 5/1994 Rivlin et al. ..... 220/23.4
6,047,827 A * 4/2000 Huang ..... 206/379
6,056,377 A * 5/2000 Jeter ..... 312/183
6,276,550 B1 * 8/2001 Cherrington ..... 220/23.4

* cited by examiner

*Primary Examiner*—Stephen Castellano
*Assistant Examiner*—Eugene Lhymn
(74) *Attorney, Agent, or Firm*—Leyendecker & Lemire, LLC; Kurt Leyendecker

(57) ABSTRACT

In one embodiment of the present invention modules for both the display and transport of books are described. Each module of the one embodiment comprises an interlocking feature for coupling two modules together with an open side of the modules facing horizontally outwardly. The interlocking feature further permits a user to partially rest a upper module on the front portion of the topside of an underlying module to align and steady the potentially heavy upper module before coupling the modules. The one embodiment modules are also configured for being stacked together with the open side of the modules facing upwardly for transport.

18 Claims, 4 Drawing Sheets

MODULAR AND TRANSPORTABLE BOOKSHELVES

FIELD OF THE INVENTION

This invention generally relates to shelving and compartmentalized storage devices. More particularly, this invention pertains to modular shelving units.

BACKGROUND

Traditionally, when moving from one location to another, a person must (i) empty his/her books from a bookcase or shelving in which the books were being displayed at the one location, (ii) pack them in suitable cardboard or other boxes for transport to the new location, (iii) unpack the books placing them on the bookcase once it has been moved or on shelving at the new location, and (iv) dispose of or store the boxes. The process, which for most people is not very enjoyable, can be rather time consuming.

To reduce the time and hassle related to moving, college students and younger apartment dwellers are known to store their books in "milk"-type crates, which can be stacked with the open side up for transportation and flipped over so the front side is facing forward and stacked on top of one another when they arrive at their new residence to serve as make shift bookcases. Unfortunately, these crates are typically poorly sized for the space efficient display of paperback books, and the crates themselves are not particularly attractive. Further, they often lack the structural integrity to allow more than three crates to be stacked on top of one another particularly if the crates have relatively heavy hardcover books stored therein. Further, if stacked three or more crates high, the resulting tower is not very stable as the crates are not physically coupled and are subject to shuffling and possibly tipping over.

Numerous bins and crates that can be stacked and include an interlocking feature have been proposed. See U.S. Pat. Nos. 4,322,118 ('118); 4,660,725; 5,038,937; 3,512,696; and D322,745. Specifically concerning books, the '118 reference describes a stackable box for both transporting and displaying books. There are, however, deficiencies to this system that make it undesirable. First, to transport the books a user must slide a cover over the front of the box to hold the books in place. The cover is stored adjacent the back of the box when the box is being used to display books. During transport, it is reasonably expected that the books will shift and move and most likely cover at least portions of the groove into which the cover is stored. Accordingly, the user will likely have to re-arrange the books once the box is placed at its new location so that the cover can be fully slid into the provided storage groove. Second, the boxes are interlocked by way of dowel pins on the tops of the boxes and recesses located on the bottoms of the boxes. A box full of hard cover books can be very heavy and aligning the recess of an upper box with the dowels of a lower box can be very difficult. Finally, the dowel and recess interlocks only prevent the upper box from moving laterally relative to the lower box, but the upper box can be separated from the lower box if the upper box is subjected to vertical forces, such as might be encountered if someone accidentally bumps against the stacked boxes.

DETAILED DESCRIPTION

Figure 1:
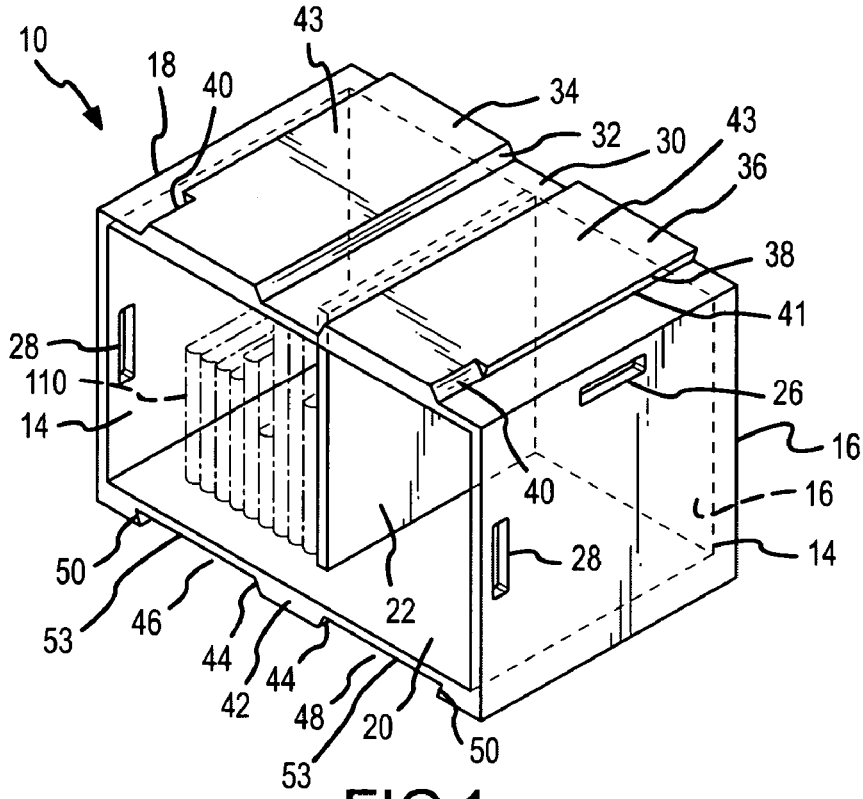
FIG. 1 is an isometric front view of a module for displaying hardcover and larger books according to one embodiment of the present invention.

One embodiment of the current invention comprises one or more modules adapted for the display and transport of books or other similar articles. Each module includes enclosed top, bottom, left, right and back sides with an open front side. Typically, the front side is vertically disposed or laterally facing to permit access to the books or other articles contained therein. In variations, a vertical wall extends between the bottom and top sides bisecting the interior of the module into two or more side by side compartments. The vertical wall provides additional structural support for the module to assist in supporting large loads when multiple modules are stacked on top of an underlying module. In other variations, the internal vertical wall can be omitted or more than one vertical wall can be provided. In the paperback module, a horizontal wall is provided that typically bisects the module horizontally resulting in an interior having upper and lower compartments, so that paperback books can be more efficiently displayed therein. Other embodiments are contemplated having differing numbers of compartments depending on the types of articles to be stored and displayed therein.

Each module of one embodiment includes track and corresponding channels on its respective top and bottom sides that permit a plurality of modules to be securely coupled when stacked upon each other to collectively form a bookcase unit. Handles are provided to assist a user in lifting a potentially heavy loaded upper module onto the top side of an underlying module. Cutaway portions in the side walls of one or more tracks on the top side proximate the front side of the underlying module permit the user to rest the bottom side of the upper module proximate its back side on the top side of the underlying module proximate its front side. This allows the user to ensure the tracks and corresponding channels of the two modules are aligned before sliding the upper module rearwardly to interlock and couple the modules together. In certain variations, an alignment channel and corresponding alignment track are provided on the top and bottom side of each module to help ensure the interlocking walls of the other tracks and corresponding channels are properly aligned to facilitate the coupling.

In one embodiment, modules when coupled together cannot typically be accidentally or inadvertently separated. However, the modules can be slid forwardly or rearwardly relative to each other to increase the stability of a bookcase unit comprising a plurality of modules stacked and coupled on top of each other. For example, a base module sitting on a floor may not be able to be pushed up against a corresponding wall because of a baseboard heater or molding that extends along the base of the wall at its intersection with the floor. If all the modules in a bookcase unit were aligned with the base module, none of the modules would be up against or in contact with the corresponding wall as they would be separated therefrom by at least the thickness of the molding or baseboard heater. Accordingly, the stability of a stacked bookcase unit would be dependant only on the foot print of the base module. As can be appreciated, the stability of units having four or more modules stacked one on top of another could be fairly precarious. However, with embodiments of the present invention an upper module can be slid rearwardly along the tracks and channels to permit the upper module to be in direct contact with the wall while still being securely coupled to the base or underlying module. Accordingly, the stability of a stacked bookcase unit using the embodiments is enhanced substantially.

In addition to being suitable for the display of books and other articles, embodiments of the present invention permit the module to be turned so the open front side is facing upwardly and stacked on top of each other in this configuration to facilitate transport of the books or other articles contained therein. To enhance the transportability of the modules, a second set of handles are provided proximate the open front side on each of the left and right sides. Further, a rectangularly shaped ridge is provided that extends around the exterior surface of the back side. The rectangularly shaped ridge is sized such that its length and width correspond to the length and width of the opening on the front side. Accordingly, the rectangular ridge of an upper module fits snuggly inside the opening of a lower module when stacked together with the open sides facing upwardly.

Terminology

The term "or" as used in this specification and the appended claims is not meant to be exclusive rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

One Embodiment of a Module for Hardcover-type Books

Referring to FIG. 1, an embodiment of a module 10 for transporting and displaying hardcover books 110 is illustrated. The module is generally box-shaped having a cavity defined by enclosed left and right sides 14, a back side 16, a top side 18 and a bottom side 20. The front side of the unit is substantially open permitting ingress and egress to the interior cavity wherein the books 110 or other articles are contained. A vertical wall 22 extends between the top and bottom sides typically bisecting the interior cavity. The vertical wall typically does not extend all the way to the edge of the front side for reasons that will become apparent below.

The module can be constructed of any suitable material in any suitable manner. Some variations can be comprised of a polymeric material that is filled or unfilled. Other variations can be comprised of a composite wood product. Yet other variations can be comprised of a composite material, such as a polymeric base including a high loading of fiberglass. Variations can also be comprised of metallic materials. In certain variations, the modules are integrally formed using a molding process, such as injection molding or rotomolding. In other variations, the modules can comprise separate pieces or sections that are joined together by mechanical fastening, adhesive bonding, welding or any other suitable process.

Two pairs of handles 26 & 28 are provided on the sides 14 of the module. The first pair of handles 26 comprises cutouts that are generally located a short distance below the intersection of the top side 18 and the respective left or right sides. The handles are typically located midway between the front and back sides and are orientated parallel to the top side. The first pair of handles facilitates the lifting of a module when the module is in its display orientation with the open front side facing horizontally outwardly. These handles are used primarily when stacking and coupling modules together to form a bookcase unit as is described in greater detail below.

The second pair of handles 28 also typically comprise cutouts, and they are generally located midway between the top and bottom sides 18 & 20 spaced a short distance from the front edge of the respective left and right sides 14. The second pair of handles are typically orientated parallel to the front edge. These handles facilitate the carrying of a module when it is in the transport orientation with the open front side facing upwardly.

The top side 18 comprises a center channel 30 flanked on either side by left and right tracks 34 & 36. The channel and the tracks extend longitudinally from the front edge to the intersection of the top side with the back side 16 generally perpendicularly with the front side opening. The left and right substantially planar walls 32 of the channel also comprise the right and left walls of the left and right tracks respectively. Each of the walls 32 intersect with the generally horizontal bottom surface of the channel to form an obtuse angle therewith.

Figure 4:
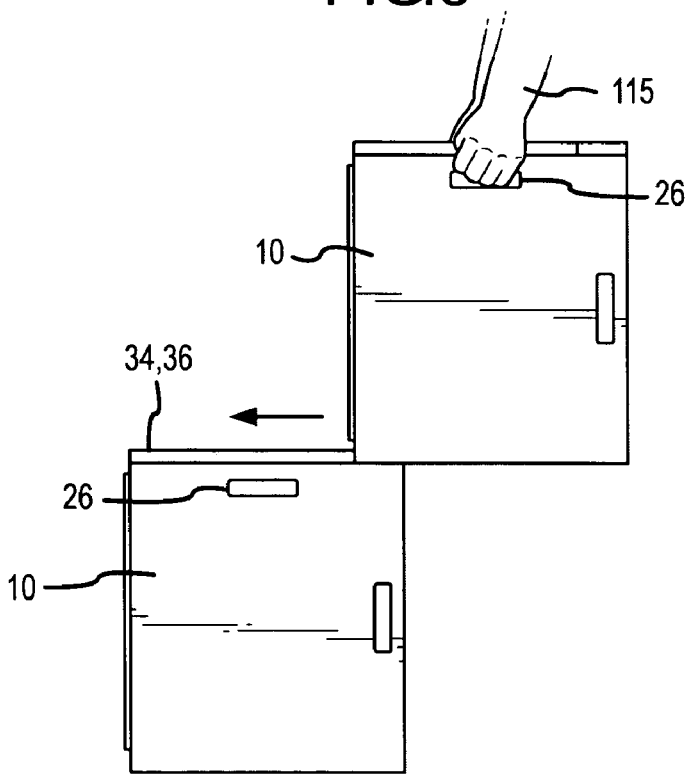
FIG. 4 is a side view of two modules illustrating the manner in which the top module is secured to the bottom module according to one embodiment of the present invention.

Each of the tracks 34 & 36 of the top side 18 includes a generally horizontal top surface 43 that extends between the track's respective common wall 32 with the channel 30 and an outer sidewall 38. Over a significant majority of the length of each track, a substantially planar first portion 41 of the outer wall intersects with the top surface of the top side, which is generally horizontal, at an acute angle. However, the acutely angled first portions terminate a short distance from the front edge of the top side, such as but not limited to 0.5–4 inches and more preferably 1–2.5". A substantially planar obtusely angled second portion 40 of the outer wall extends between the termination of the first portion and the front edge. The obtusely angled second portions permit a user to rest a bottom side of a module proximate its back wall 16 on the top side of an underlying module proximate its front side to properly align the tracks 34 & 36 of the upper module's top side with a corresponding set of channels 46 & 48 on the bottom side of the upper module. FIG. 4 is an illustration showing an upper module resting on a lower module and being supported by a user 115 prior to the coupling of the modules together by sliding the upper module rearwardly.

The left and right tracks 34 & 36 in combination with the center channel 30 of the one embodiment's top side 18 can be also described as a dovetail tenon that is raised above the top surface of the top side and has a channel with obtusely angled side walls formed in the dovetail's top side. As similar to a typical dovetail tenon, the first portions 41 of the outer sidewalls 38 are each angled acutely relative the intersection of the first portions with the dovetail's top surface 43 and also extend inwardly from the intersection with the dovetail's top surface. The second portions 40 of the sidewall comprise front portions of the dovetail tenon that have the flared portion of the tenon (or portion of the tenon that is shaped arguably similar to a dove's tail) removed or omitted. As illustrated, the second portions form an obtuse angle with the top side of the dovetail tenon; however, the omitted or removed portion can have any suitable shape as long as substantially the entire surface of the second portion is located inwardly of the intersection of the first portion with the top surface of the top side, such that the second portion does not interlock with a dovetail mortise that is configured to interlock with the first portions.

Figure 3:
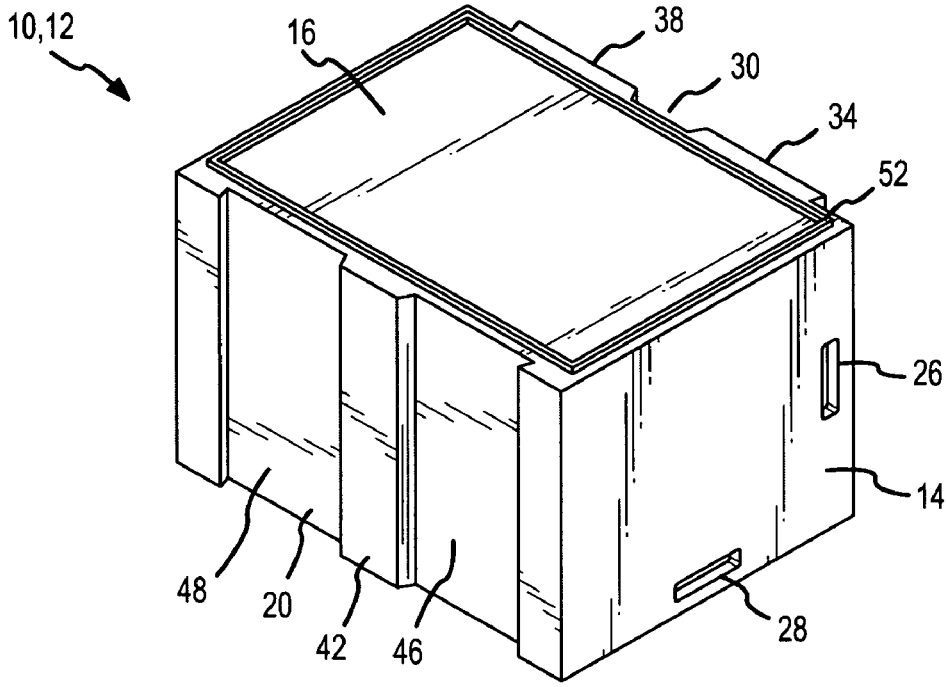
FIG. 3 is an isometric bottom side view of either a paperback or hardcover module further showing the back side of the back wall according to one embodiment of the present invention.

Referring to FIG. 1 as well as FIG. 3, left and right channels 46 & 48 that are substantially vertically aligned with the left and right tracks 34 & 36 extend longitudinally from the front edge of the bottom side 20 to the bottom side's intersection with back side 16 of the module. The channels are separated by a center track 42 on the bottom side that corresponds with the center channel 30 on the top side 18.

The center track 42 of the bottom side 20 includes two substantially planar walls 44 that extend from the front edge to the intersection of the bottom side with the back wall 16. Each wall, which also forms the interior wall of one of the left and right channels 46 & 48, intersects with a generally horizontal bottom surface of one of the left and right channels to form an obtuse angle. The center track is dimensioned to be received into a center channel of another module's top side 18 when the module is placed on top of the other module.

Each of the left and right channels 46 & 48 also includes a longitudinally-extending substantially planar outer sidewall 50 that forms an acute angle with the generally horizontal bottom surface of its corresponding channel. The acute angle of the outward-most channel wall and the acute angle of the acute first portion of the outer wall of the left and right tracks 34 & 36 of on the top side 18 are substantially the same, such that the left and right channels can matingly receive the left and right tracks of another similar module therein when the two modules are slidingly coupled together.

The left and right channels 46 & 48 in combination with the center track 42 of the one embodiment's bottom side can be also described as a dovetail mortise that is recessed into the surface of the bottom side and has a track with obtusely angled side walls formed in the dovetail's bottom surface 53. As similar to a typical dovetail mortise, the outer sidewalls 50 are each angled acutely relative to the dovetail mortise's bottom surface 53 and also extend inwardly from the intersection of the sidewalls with the dovetail mortise's top surface. Typically, the dovetail mortise of the bottom side is adapted to slidably engage a dovetail tenon of another module that has similar dovetail tenon dimensions as the dovetail tenon of the module's top side 18.

Still referring to FIG. 3, a rectangular ridge 52 extends around the exterior surface of the back side 16 spaced inwardly a small distance from the respective edges of the back side. The length and width of the rectangle formed by the ridge correspond to the length and width of the opening of the front side. Accordingly, when a module is placed on the ground with the front side opening facing upwardly, such as when configured for transport, another similarly dimensioned module can be placed on top of the underlying module as shown, for example, in FIG. 6. The rectangular ridge is received into the front side's opening and prevents the upper module from sliding relative to the lower module.

One Embodiment of a Module for Softcover-type Books

Figure 2:
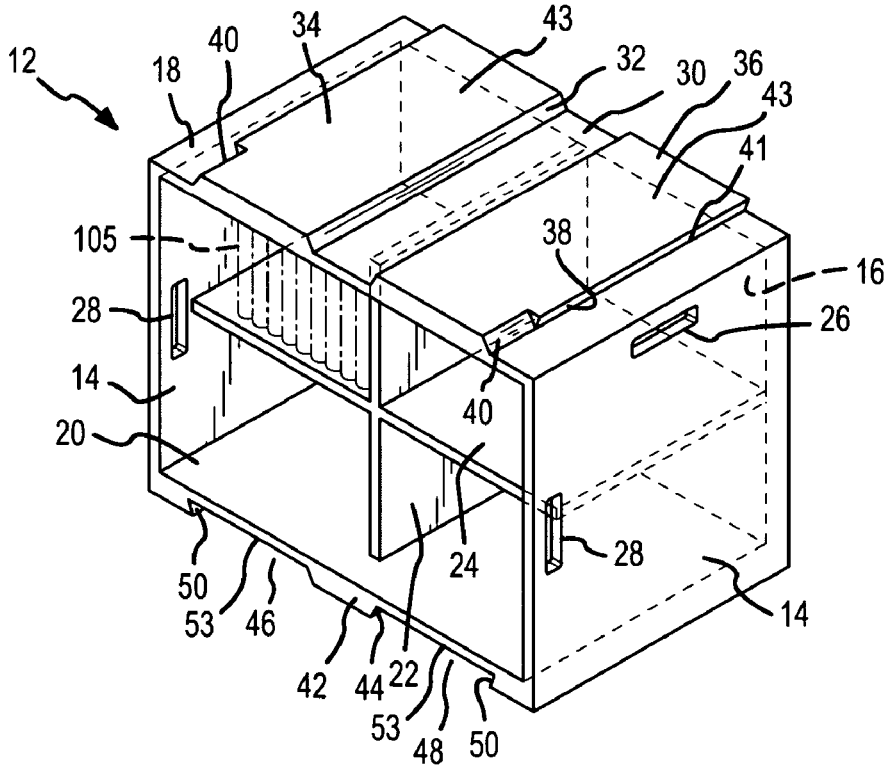
FIG. 2 is an isometric front view of another module for displaying paperback books according to one embodiment of the present invention.

Generally, as illustrated in FIG. 2, an embodiment of a module 12 for use with softcover-sized books 105 is similar to the module 10 described above concerning hardcover books. Several differences can, but do not necessarily, include (i) a shorter depth between the front side and the back side 16, (ii) a different height between the bottom and top sides 18 & 20, and (iii) a second interior wall 24 horizontally bisecting the interior of the module 12. In all other respects, the illustrated softcover module embodiment is typically the same as the illustrated hardcover module embodiment: (a) two pairs of handle cutaways 26 & 28 are provided; (b) a vertically-extending interior wall 22 is provided; (c) similarly dimensioned and configured left and right channels 46 & 48 and tracks 34 & 36 are provided; and (d) a center channel 30 and corresponding center track 42 are also provided. In certain variations, the dimensions of the tracks and channels permit the hardcover and softcover modules 10 & 12 to be used together to fabricate a book shelf unit as illustrated in FIG. 5.

The most notable distinction between the softcover module embodiment and the hardcover module embodiment is the horizontally-extending interior wall 24 that permits two layers of softcover books to be stacked on top of each other in a single module to help ensure more efficient space storage and display of softcover books. Accordingly, an embodiment of a softcover module can be fabricated that has the same width and height as a hardcover module embodiment so that they can be each be interchangeably stacked on top of each other for transport (i.e. the rectangular ridge of either is matingly received into the front side opening of the other). In other variations, the height of the softcover modules can be reduced such that only a single row or layer of books can be stored therein.

One Embodiment of a Bookcase Unit

Figure 5:
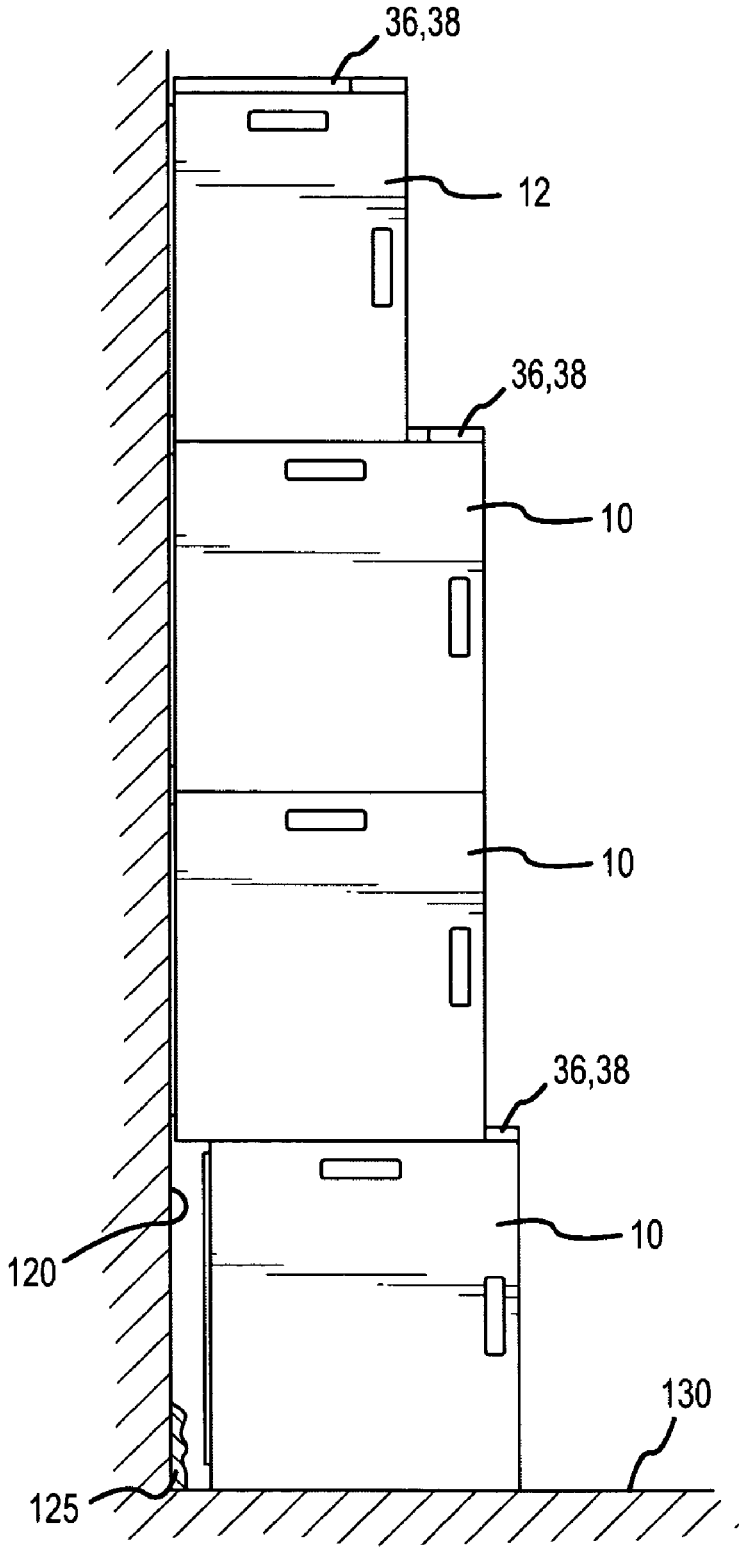
FIG. 5 is a side view of a plurality of hardcover and paperback modules secured together to form a bookcase according to one embodiment of the present invention.

Referring to FIG. 5, a bookcase unit according to one embodiment that comprises a plurality of stacked and coupled hardcover and softcover modules 10 & 12 is illustrated. Each of the modules are coupled to the underlying module by sliding the left and right channels 46 & 48 on its bottom side 20 over the corresponding tracks 34 & 36 on the underlying modules top side 18 thereby locking the modules together.

Referring to FIG. 4, to couple two modules together in the display configuration, a user picks up a module by the first set 26 of handles and lifts the module upwardly. Next, the user lowers the rear end of the bottom side 20 proximate the back side 16 down onto the top side 18 of an underlying module proximate the underlying module's front side. The user moves the module side to side if necessary until the center track 42 is received into the channel 30 of the underlying module. Because of the obtusely-angled second portion 40 of the outer wall of each of the tracks 34 & 36, the module can be rested on the top side of the underlying module with the bottom surfaces of the bottom side flush against the top surfaces of the underlying module. Next, the user pushes the module rearwardly engaging the acutely-angled first portion of the track's outer walls with the corresponding outer walls 46 & 48 of the modules bottom side 20 to interlock and couple the two modules together.

It is to be appreciated that without the obtusely-angled second portions 40 of the tracks' outer walls, a user would have to simultaneously hold the module at the proper height relative to the underlying module, align the tracks and channels laterally, and slide the upper module rearwardly to fully engage the interlocking walls of the corresponding tracks and channels. This operation is made more difficult the heavier the module is because of books or other items contained therein. Conversely, embodiments of the modules described herein permit a user to concentrate first on lowering and laterally aligning the module with the underlying module and then concentrate on sliding the module rearwardly to couple the modules without having to worry about the height at which he/she is holding the module.

Still referring to FIG. 5, the bottom module is resting on a floor 130 or other ground surface spaced from the wall 120 a short distance because of molding 125 that prohibits the module from being slid flushly against the wall. Aside from molding, wires, baseboard heaters and other items could prevent that the bottom module from being placed directly against the wall. The configuration of the interlocking tracks and channels permit a module coupled to the bottom module to be slid rearwardly until it contacts the wall, thereby permitting the bookcase unit to be stabilized against the wall and minimizing the risk of the bookcase unit falling over.

As illustrated, the top illustrated module comprises a paperback module 12 that has a depth significantly less than the depth of the hardcover modules 10. It is slid fully rearwardly such that its back side 16 is flush against the wall. However, a user may desire to situate the paperback module so that its front side is aligned with the front sides of the other modules for a more uniform appearance.

The interior vertical walls 22 of certain variations and embodiments provide additional structural support to the modules, particularly the lower ones in a bookcase unit. Accordingly, a plurality of modules can be stacked one on top of another, even when fully loaded with heavy books and items without causing the bottom module to break or collapse.

As illustrated the book case unit comprises a single column of modules; however, multiple columns of modules can be placed side by side. In variations, means for fastening two or more columns together can be provided to create a larger unitary bookcase unit. For instance, one or more fastener holes can be provided in the left and rights sides 14 of the modules that can be aligned with fastener holes in adjacent modules facilitating the connection of the modules with one or more threaded fasteners. The holes can be countersunk such that any fastener used therein does not protrude significantly into the interiors of either joined module. In another variation clips can be provided that fit over and around the front edges of two adjacent sides.

Shipping Configuration of a Plurality of Modules According to One Embodiment

Figure 6:
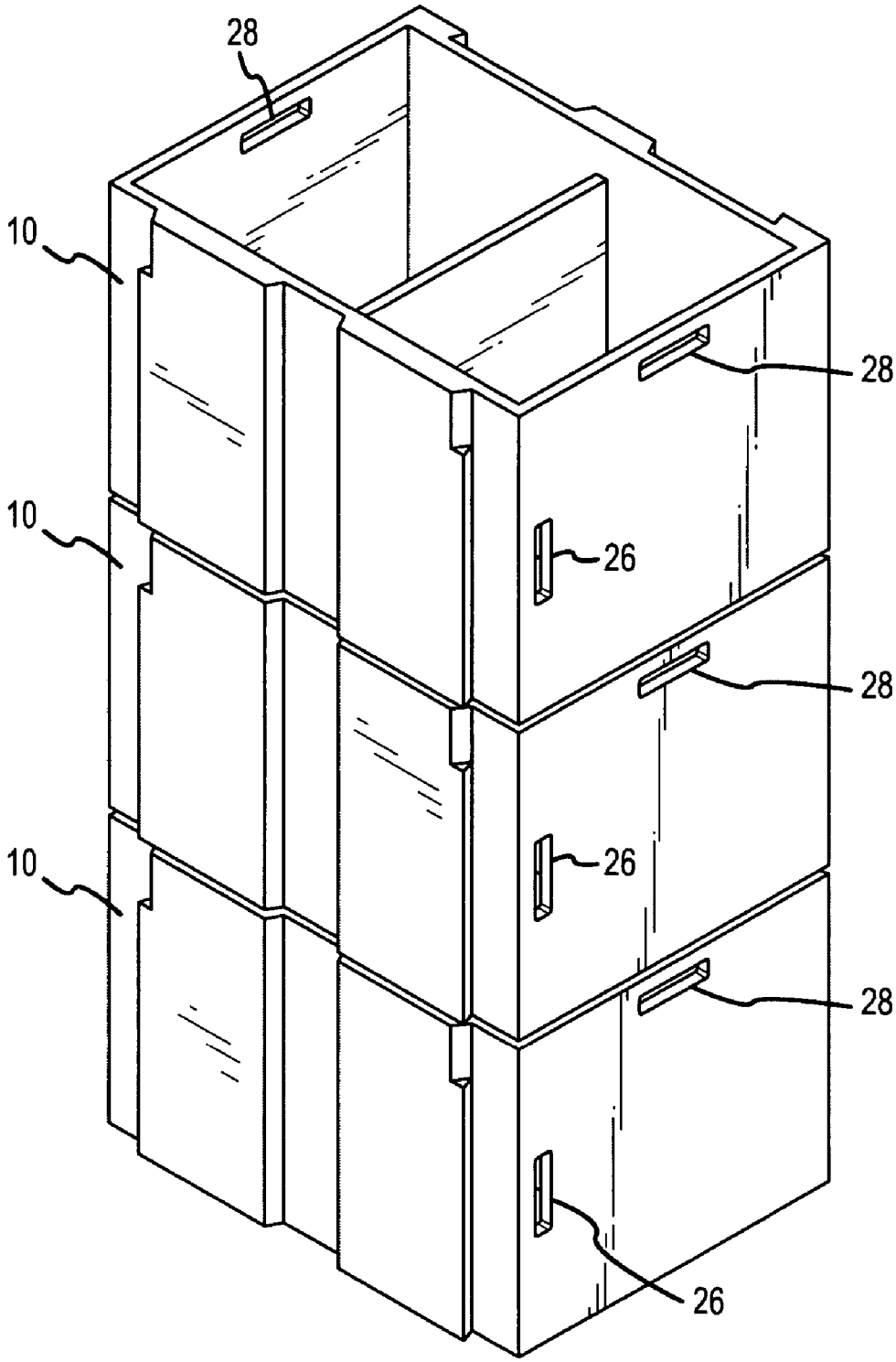
FIG. 6 is an isometric view of a plurality of hardcover modules stacked together according to one embodiment of the present invention with the open front sides facing upwardly as the modules would be configured for transport.

Referring to FIG. 6, three hardcover modules 10 are illustrated in a stacked configuration for transport. In this configuration, the modules are orientated with the open front sides facing upwardly to fully contain the books or other articles contained therein so they will not fall out while being jostled and shifted during transport, such as in the back of a moving truck. The modules are carried in this configuration using the second pair of handles 28. The modules can be stacked upon one another by lowering the rectangular ridge 52 of the back side 16 of one module down into the open front side of an underlying module. Because the rectangular ridge fits down into the interior of the underlying module through the open front side, the interior walls 22 & 24 are offset at least the vertical dimension of the ridge. Concerning the horizontal wall 24 (as applicable), it is also offset a sufficient distance from the front edge to permit unhindered functionality of the second pair of handles 28. However, in variations of the one embodiment, the ridge 52 can be removed from the locations that will correspond to the locations of the interior walls thereby permitting the walls to be flush with the open front side. In the shipping configuration, the upper module is not free to slide or move about relative to the lower module. As desired multiple modules can be stacked on top of one another. In other variations and embodiments, the ridges can be replaced with a plurality of protrusions of any suitable shape and configuration that are distributed appropriately on the exterior surface of the back side to functionally accomplish the same result as the ridge.

If the width and height of the softcover and hardcover modules are essentially the same then they can be stacked together for shipping. If the height of the softcover module differs from that of the hardcover module, the rectangular ridge of the lower height module will not fit within the higher height module as securely. However provided they share the same track and channel configuration and dimensions, they can still be coupled together to form an integral bookcase unit.

Other Embodiments and Other Variations

The various preferred embodiments and variations thereof illustrated in the accompanying figures and/or described above are merely exemplary and are not meant to limit the scope of the invention. It is to be appreciated that numerous variations to the invention have been contemplated as would be obvious to one of ordinary skill in the art with the benefit of this disclosure. All variations of the invention that read upon the appended claims are intended and contemplated to be within the scope of the invention.

The specific configuration of the various tracks and channels can vary substantially. For example, a center track and corresponding interlocking channel could be used instead of a separate left and right track and channel configuration. In such a configuration one or more alignment tracks and channels, such as the center track and channel of the illustrated embodiment could be provided that flank the interlocking center channel and track. In other variations and embodiments, the interlocking tracks can be located on the bottom side of the module and the interlocking channels can be located on the top side of the module. Numerous other track and channel configurations can be used as well. The actual angles of the obtuse and acute portions of the track and channel walls can vary as well. For instance, the second portion 40 of the outer wall of the left and right tracks could simply comprise a cutaway portion that provides clearance to the outer walls of the left and right channels when an overlying module is set thereon. In another variation, the tracks may have no cutaway portions, but the rear portions of the channels proximate the back side of the bottom end may each be cutaway such that corresponding tracks can be received therein prior to coupling the modules by sliding the modules together. Further, the modules are primarily described herein for use with books. It is to be appreciated, however, that similar modules can be used to carry any type of article that can fit therein. The size of the modules are not limited in any manner to the dimensions necessary to transport and/or display books.

I claim:

1. A module suitable for displaying books or other articles comprising:

spaced apart left and right sides;

an open front side bounded on two opposite front side edges by the left and right sides;

a back side spaced from the open front side and intersecting with the left and right sides along respective left and right edges; and top and bottom sides, each intersecting with the left, right, and back sides along the respective left, right and back edges thereof one of the top and bottom sides including a tenon and another of the top and bottom sides including a mortise, wherein:

the tenon includes a tenon pair of opposing outwardly facing sidewalls comprising a dovetail section tenon pair of opposing outwardly facing sidewalls, the dovetail section tenon pair of opposing outwardly facing sidewalls being substantially acutely angled relative to one outside surface of the tenon, the one outside surface of the tenon being substantially parallel to the top and bottom sides, and located on an outwardly facing surface of the tenon: and the mortise includes a mortise pair of opposing outwardly facing sidewalls comprising a dovetail section mortise pair of opposing outwardly facing sidewalls, the dovetail section being acutely angled relative to one outside surface of the mortise, the one outside surface of the mortise being substantially parallel to the top and bottom sides, and located on an outwardly facing surface of the mortise; and the tenon pair or mortise pair of opposing outwardly facing sidewalls further comprise a non-dovetail section tenon pair or mortise pair of opposing outwardly facing sidewalls, respectively, the non-dovetail section of the tenon pair or mortise pair of opposing outwardly facing sidewalls having substantially planar surfaces on substantially different planes than the dovetail section of the tenon pair or mortise pair of opposing outwardly facing sidewalls, respectively; and the non-dovetail section of the tenon pair or mortise pair of opposing outwardly facing sidewalls is proximate one end of the respective tenon or mortise.

2. The module of claim 1 wherein (i) an intersection of each sidewall of the tenon pair with a top surface of the one of the top and bottom sides and (ii) an intersection of each sidewall of the mortise pair with a bottom surface of the other of the toy and bottom side are substantially parallel to at least one of the left and right sidewalls.

3. The module of claim 1, wherein the one end of the respective tenon or mortise comprises the intersection of the top side and the open front side.

4. The module of claim 1, wherein (i) the mortise includes a mortise bottom surface and a track extends outwardly from a portion of the mortise bottom surface, and (ii) the tenon includes a tenon top surface and a channel is recessed in a portion of the tenon top surface.

5. The module of claim 4, wherein the track includes track sidewalls, the track sidewalls forming an obtuse angle with the tenon top surface, and wherein the channel includes channel sidewalls, the channel sidewalls forming an obtuse angle with the channel bottom surface.

6. The module of claim 4, wherein the channel and the track are substantially vertically aligned.

7. The module of claim 1, wherein the non-dovetail section tenon pair or mortise pair of opposing outwardly facing sidewalls is about 90 to 180 degrees, inclusive, relative to the one outside surface of the tenon or mortise, respectively.

8. An assembly of modules of claim 1, comprising a first module with the first module's back side resting on a substantially horizontal surface and the open front side facing substantially vertically upwardly, and a second module with the second module's back side resting on the front side of the first module and the second module's one or more raised protrusions being received into the first module's open front side.

9. An assembly of modules of claim 1, comprising a first module with the first module's bottom side resting on a substantially horizontal surface and the open front side facing substantially horizontally outwardly, and a second module with the second module's bottom side interlockably coupled with the first module's top side to prevent lateral movement of the second module relative to the first module along at least one lateral axis.

10. The assembly of modules of claim 9, wherein the interlockable coupling prevents vertical movement of the second module relative to the first module.

11. The module of claim 1, further comprising a first interior wall extending from the top side to the bottom side in an interior cavity of the module.

12. The module of claim 11, further comprising a second interior wall extending from the left side to the right side in the interior cavity of the module.

13. The module of claim 1, further comprising a first and second pair of handles, the first pair of handles having one handle located on each of a respective left side or right side, each handle of the first pair of handles being generally parallel to and proximate the intersection of the module's respective left or right side with the top side, the second pair of handles having one handle located on one each of opposite, substantially parallel sides, each handle of the second pair of handles being located proximate and parallel with an edge of the front side.

14. A module suitable for transporting and displaying books or other articles comprising top, bottom, left, right, back and front sides forming an interior cavity wherein:

(i) one side of the top, bottom, left, right, back and front sides is an open side;

(ii) at least one track side of the top, bottom, left, right, back and front sides includes one or more tracks, the one or more tracks together having (a) at least one substantially planar first sidewall forming an acute angle with exterior surfaces of the one or more tracks and facing in a first direction, and (b) at least one substantially planar second sidewall forming an acute angle with the exterior surfaces of the one or more tracks and facing in a second direction with the second direction being opposite the first direction, the exterior surfaces of the one or more tracks being generally parallel to an exterior surface of the at least one track side;

(iii) at least one channel side of the top, bottom, left, right, back and front sides includes one or more channels, the one or more channels together having (a) at least one substantially planar first sidewall forming an acute angle with interior surfaces of the one or more channels and facing in a first direction, and (b) at least one substantially planar second sidewall forming an acute angle with the interior surfaces of the one or more channels and facing in a second direction with the second direction being opposite the first direction, the interior surfaces of the one or more channels being generally parallel to an exterior surface of the at least one channel side, the at least one channel side being opposite the at least one track side, longitudinal center axes of the one or more channels being located substantially a same distance from an adjacent side of the top, bottom, left, right, back and front sides as longitudinal center axes of the one or more tracks are located from the adjacent side, the adjacent side being substantially parallel with the each longitudinal center axis; and (iv) one or more raised protrusions extending around at least a portion of an exterior surface of a closed side, the closed side being (i) opposite the open side, and (ii) one of the top, bottom, left, right, back and front sides, the one or more raised protrusions each being spaced inwardly from an intersection of the closed side with an intersecting side, the intersecting side being one or more of the top, bottom, left, right, back and front sides, excluding the open side, a distance generally similar to the thickness of the intersecting side proximate the open side.

15. The module of claim 14, further comprising first and second pair of handles, one handle of each of the first and second pairs of handles being located on respective opposing sides of the top, bottom, left, right, back and front sides excluding the open and closed sides, the opposing sides being substantially perpendicular to the open and closed sides, the first pair of handles being generally perpendicularly orientated relative to the second pair of handles.

16. The module of claim 14, wherein the acutely-angled substantially planer first and second sidewalls of the one or more tracks terminate 0.5–4 inches from the intersection of the at least one track side of the top, bottom, left, right, back and front sides with one adjacent side of the top, bottom, left, right, back and front sides.

17. The module of claim 14, further comprising: (i) at least one other channel extending on the at least one track side, the other channel having at least one substantially planar sidewall forming an obtuse angle with a bottom surface of the other channel, the bottom surface of the other channel being substantially parallel to the exterior surface of the at least one track side; and (ii) at least one other track extending on the at least one channel side, the other track having at least one substantially planar sidewall forming an obtuse angle with an exterior surface of the other track, the exterior surface of the other channel being substantially parallel to the exterior surface of the at least one channel side; wherein a longitudinal axis of the other channel is substantially parallel to the longitudinal axis of the other track.

18. The module of claim 1, wherein the non-dovetail section tenon pair or mortise pair of opposing outwardly facing sidewalls are closer together than the dovetail section tenon pair or mortise pair, respectively, of opposing outwardly facing sidewalls.

* * * * *